US012215956B2

(12) United States Patent
Kincel et al.

(10) Patent No.: US 12,215,956 B2
(45) Date of Patent: Feb. 4, 2025

(54) FIREARM ACCESSORY MOUNT WITH ANGLED HARDWARE

(71) Applicant: BRAVO COMPANY MFG, INC., Hartland, WI (US)

(72) Inventors: Eric Stephen Kincel, Coeur d'Alene, ID (US); Jeffrey James O'Brien, Coeur d'Alene, ID (US)

(73) Assignee: BRAVO COMPANY MFG, INC., Harland, WI (US)

( * ) Notice: Subject to any disclaimer, the term of this patent is extended or adjusted under 35 U.S.C. 154(b) by 0 days.

(21) Appl. No.: 17/416,939

(22) PCT Filed: Dec. 20, 2019

(86) PCT No.: PCT/US2019/067933
§ 371 (c)(1),
(2) Date: Jun. 21, 2021

(87) PCT Pub. No.: WO2020/132491
PCT Pub. Date: Jun. 25, 2020

(65) Prior Publication Data

US 2022/0042773 A1 Feb. 10, 2022

Related U.S. Application Data

(60) Provisional application No. 62/784,117, filed on Dec. 21, 2018.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 2,743,525 A 5/1956 Leupold
3,295,811 A * 1/1967 Giwosky ..... F41G 11/003
248/229.11

(Continued)

FOREIGN PATENT DOCUMENTS

DE 202004010012 U1 9/2004
EP 2743631 A2 6/2014

OTHER PUBLICATIONS

Geissele Automatics, "Super Precision—T1 Series Optic Mounts" <https://geissele.com/super-precision-t1-series.html> webpage accessed Sep. 11, 2018 (4 pages).

(Continued)

*Primary Examiner* — Michelle Clement
(74) *Attorney, Agent, or Firm* — Michael Best & Friedrich LLP

(57) ABSTRACT

An accessory mount for coupling an accessory to a mounting interface on a firearm includes a body with a lower engagement surface configured to engage a top surface of the mounting interface, a fixed clamp member extending from the body, and a movable clamp member configured to move along an axis relative to the fixed clamp member to clamp the mounting interface between the movable clamp member and the fixed clamp member. The axis and the lower engagement surface define an included angle greater than 0 degrees.

23 Claims, 9 Drawing Sheets

(56) References Cited

U.S. PATENT DOCUMENTS

| | | | | |
|---|---|---|---|---|
| 3,405,448 | A * | 10/1968 | Weatherby | F41G 11/003 42/127 |
| 5,680,725 | A * | 10/1997 | Bell | F41G 11/003 42/127 |
| 6,295,754 | B1 | 10/2001 | Otteman et al. | |
| 7,685,759 | B2 * | 3/2010 | Teetzel | F41G 11/003 42/127 |
| D637,260 | S | 5/2011 | Swan | |
| 8,020,335 | B2 | 9/2011 | Larsson et al. | |
| D680,185 | S | 4/2013 | Adamson | |
| 8,490,313 | B2 * | 7/2013 | Frascati | F41G 11/003 42/72 |
| 8,683,732 | B2 * | 4/2014 | Joplin | F41G 11/003 42/124 |
| 8,893,424 | B2 * | 11/2014 | Haering | F41G 1/387 42/126 |
| D718,833 | S | 12/2014 | Huang | |
| 9,038,305 | B2 | 5/2015 | Volfson | |
| 9,568,281 | B1 * | 2/2017 | Chen | F41G 11/003 |
| 9,574,852 | B1 | 2/2017 | McKillips et al. | |
| D785,745 | S | 5/2017 | McKillips | |
| 9,671,198 | B2 | 6/2017 | Bartoszewicz | |
| 9,677,854 | B1 | 6/2017 | Tran | |
| D823,971 | S | 7/2018 | Houde-Walter | |
| D826,360 | S | 8/2018 | Cheng et al. | |
| 10,041,765 | B2 * | 8/2018 | McMakin | F41G 1/38 |
| 10,132,596 | B2 | 11/2018 | Bartoszewicz | |
| D835,748 | S | 12/2018 | Stewart | |
| D849,871 | S | 5/2019 | McKillips | |
| D865,107 | S | 10/2019 | Batten | |
| D881,315 | S | 4/2020 | Liu | |
| 10,655,929 | B2 | 5/2020 | Stewart | |
| D907,161 | S | 1/2021 | Chin | |
| D921,816 | S | 6/2021 | Lee | |
| 11,067,363 | B2 * | 7/2021 | Galli | F41G 11/003 |
| 11,162,518 | B1 * | 11/2021 | Macy | F16B 2/065 |
| 2008/0216380 | A1 * | 9/2008 | Teetzel | F41G 11/003 42/127 |
| 2010/0005697 | A1 * | 1/2010 | Fluhr | F41G 1/02 42/111 |
| 2010/0229450 | A1 | 9/2010 | Becker et al. | |
| 2012/0180363 | A1 * | 7/2012 | Frascati | F41G 11/003 42/90 |
| 2013/0283663 | A1 * | 10/2013 | Joplin | F41G 11/003 42/124 |
| 2013/0318852 | A1 * | 12/2013 | Teetzel | F41C 27/00 42/90 |
| 2017/0102213 | A1 * | 4/2017 | Bartoszewicz | F41G 11/003 |
| 2017/0261288 | A1 * | 9/2017 | Bartoszewicz | F41G 11/003 |
| 2020/0109916 | A1 | 4/2020 | Eichelberger et al. | |
| 2022/0042772 | A1 * | 2/2022 | Raley | F41G 11/003 |
| 2022/0042773 | A1 * | 2/2022 | Kincel | F41C 27/00 |

OTHER PUBLICATIONS

Geissele Automatics, "Super Precision Scope Mount, 30mm for AR-15, 1.93" Height,"<https://geissele.com/super-precision-scope-mount-30mm-for-ar-15-1-93-height.html> webpage accessed Sep. 11, 2018 (3 pages).

Leupold, "Mark 4 Mounting Systems," <https://www.leupold.com/product-series/mark-4-mounting-systems> webpage accessed Sep. 11, 2018 (3 pages).

Wikipedia, "Picatinny Rail," <https://en.wikipedia.org/wiki/Picatinny_rail> webpage accessed Mar. 13, 2020 (3 pages).

Wikipedia, "Weaver Rail Mount," <https://en.wikipedia.org/wiki/Weaver_rail_mount> webpage accessed Mar. 13, 2020 (4 pages).

Geissele Automatics, "Super Precision Optic Mount for the Aimpoint Micro Series Installation Instructions," <https:// geissele.com/amfile/file/download/file/14861fc58ef430184ac45d30bb184933/product/471/> webpage accessed Mar. 13, 2020 (2 pages).

International Search Report and Written Opinion for Application No. PCT/US2019/067933 dated Mar. 18, 2020 (13 pages).

Bravo Company USA, "Trijicon RM34 Tall Picatinny Rail Mount for RMR," website visited Aug. 21, 2021, <URL: https://bravocompanyusa.com/trijicon-rm34-tall-picatinny-rail-mount-for-rmr/>, (4 pages).

Ammoland, "Primary Arms Optics Releases New Glx Microdot Riser Mounts," by Jim Grant, Ammoland, published Nov. 24, 2020, website visited Aug. 20, 2021, <URL: https://www.ammoland.com/2020/11/primary-arms-optics-releases-new-glx-microdot-riser-mounts/#axzz745vD6wgU> (Year 2020), (3 pages).

UTG, "Super Slim T1 Mount," Date First Available May 28, 2020, website visited Aug. 20, 2021, <URL: https://www.amazon.com/UTG-Super-Mount-Absol ute-Co-Witness/dp/B07R9GV7FQ/ref=pd_I po_1?pd_rd_i=B07R9GV7FQ&psc=1>, (Year 2020), (9 pages).

Strike Industries, "3 Piece—T1 Riser Optic Mount (Black))," Date First Available Aug. 20, 2019, website visited Aug. 20, 2021, <URL: https://www.amazon.com/Strike-Industries-Piece-Riser-Optic/dp/B07WDSXZLP>, (Year: 2019), (6 pages).

* cited by examiner

FIREARM ACCESSORY MOUNT WITH ANGLED HARDWARE

CROSS-REFERENCE TO RELATED APPLICATIONS

This application claims priority to U.S. Provisional Patent Application No. 62/784,117, filed Dec. 21, 2018, the entire content of which is incorporated herein by reference.

FIELD

The present disclosure relates to mounting assemblies for firearm accessories.

BACKGROUND

Firearm accessories, and particularly optics such as scopes and sights, require a strong and rigid mount to remain secured in place and properly aligned under repeated recoil forces. A variety of different standards have been developed for mounting accessories to firearms. For example, one commonly used standard mounting arrangement is the Picatinny or MIL-STD-1913 rail.

A Picatinny rail includes a plurality of grooves or notches that extends across the width of the rail at regularly spaced intervals. Typically, an accessory mount used to mount a firearm accessory to a Picatinny rail includes a fixed bolt extending horizontally across the width of the accessory mount. A nut is engaged with the fixed bolt and bears against a movable clamp member when rotated relative to the fixed bolt to move the clamp member along the fixed bolt. This clamps the accessory mount to the rail. The fixed bolt sits within one of the notches in the rail to secure the accessory mount against recoil forces. One example of such an accessory mount is the Super Precision® T1 Series Optic Mount produced by GEISSELE.

SUMMARY

The arrangement of the horizontal fixed bolt and the nut in the typical accessory mount described above results in the nut projecting significantly beyond the width of the remainder of the accessory mount. As such, straps, webbing, clothing, etc. can be easily snagged on the nut. In addition, a user's hands are more likely to contact and scrape against the nut when handling the firearm. Accordingly, a need exists for a firearm accessory mount that is more compact in the width direction of the mount.

The present disclosure provides, in one aspect, an accessory mount for coupling an accessory to a mounting interface on a firearm. The accessory mount includes a body with a lower engagement surface configured to engage a top surface of the mounting interface, a fixed clamp member extending from the body, and a movable clamp member configured to move along an axis relative to the fixed clamp member to clamp the mounting interface between the movable clamp member and the fixed clamp member. The axis and the lower engagement surface define an included angle greater than 0 degrees.

The present disclosure provides, in another aspect, an accessory mount for coupling an accessory to a mounting interface on a firearm, the mounting interface having a top surface and a notch formed in the top surface. The accessory mount includes a body with a lower engagement surface configured to engage the top surface of the accessory interface, a fixed clamp member extending from the body, and a movable clamp member configured to move along an axis relative to the fixed clamp member to clamp the accessory interface between the movable clamp member and the fixed clamp member. The accessory mount also includes an actuator configured to move the movable clamp member along the axis, and a recoil lug projecting from the lower engagement surface such that the recoil lug is insertable into the notch.

The present disclosure provides, in another aspect, a method of coupling an accessory mount for a firearm accessory to an accessory interface having a first side, a second side, and a top side extending between the first side and the second side. The method includes positioning a lower engagement surface of the accessory mount against the top side of the accessory interface, positioning a fixed clamp member of the accessory mount against the first side of the accessory interface, moving a movable clamp member of the accessory mount along an axis and into engagement with the second side of the accessory interface, and clamping the accessory interface between the fixed clamp member and the movable clamp member to secure the accessory mount to the accessory interface. The axis is oriented at a non-zero angle relative to the lower engagement surface.

Other features and aspects of the disclosure will become apparent by consideration of the following detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
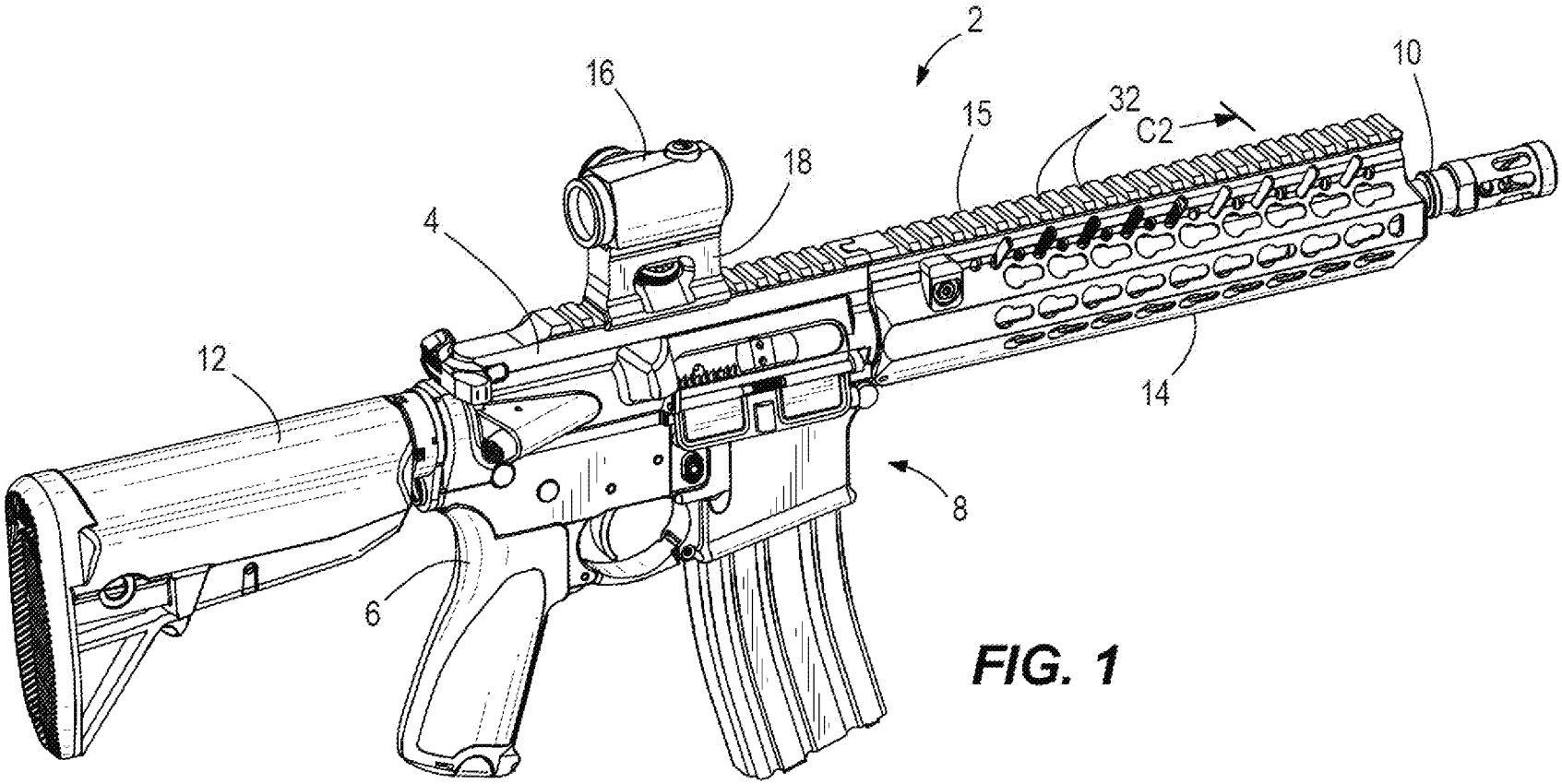
FIG. 1 is a side view of a firearm including a rail to which an accessory can be attached.

With reference to FIG. 1, an exemplary firearm 2 includes an upper receiver 4, a lower receiver 6 that cooperates with the upper receiver 4 to define a body 8 of the firearm 2, and a barrel 10 extending from the body 8. A stock 12 is coupled to the body 8 opposite the barrel 10, and a handguard 14 surrounds a portion of the barrel 10 adjacent the upper receiver 4.

The firearm 2 also includes an accessory interface or rail 15, with portions extending along a top side of the handguard 14 and the upper receiver 4. An accessory 16 (e.g., a flashlight, scope, sight, handgrip, sling mount, etc.) is removably coupled to the rail 15 by an accessory mount 18. The illustrated rail 15 is a Picatinny rail. As such, the rail 15 has a top side 21 including a top surface 22 (FIG. 2), a first side 23 including a first upper angled surface 24 and a first lower angled surface 28, and a second side 25 opposite the first side 23 and including a second upper angled surface 26 and a second lower angled surface 30.

In the illustrated embodiment, the upper angled surfaces 24, 26 extend downward and outward (e.g., at a 45 degree angle) from the top surface 22. The lower angled surfaces 28, 30 extend downward and inward (e.g., at 90 degree angles) relative to the respective upper angled surfaces 24, 26. A chamfer or transition surface 31 may be disposed between the upper angled surfaces 24, 26 and the lower angled surfaces 28, 30, respectively. In the illustrated embodiment, a plurality of grooves or notches 32 is formed in the top surface 22 of the rail 15, and the illustrated notches 32 extend across the width of the rail 15 at regularly spaced increments (FIG. 1). In other embodiments, the rail 15 may have other geometries and/or other features suitable for mounting accessories thereto.

Figure 2:
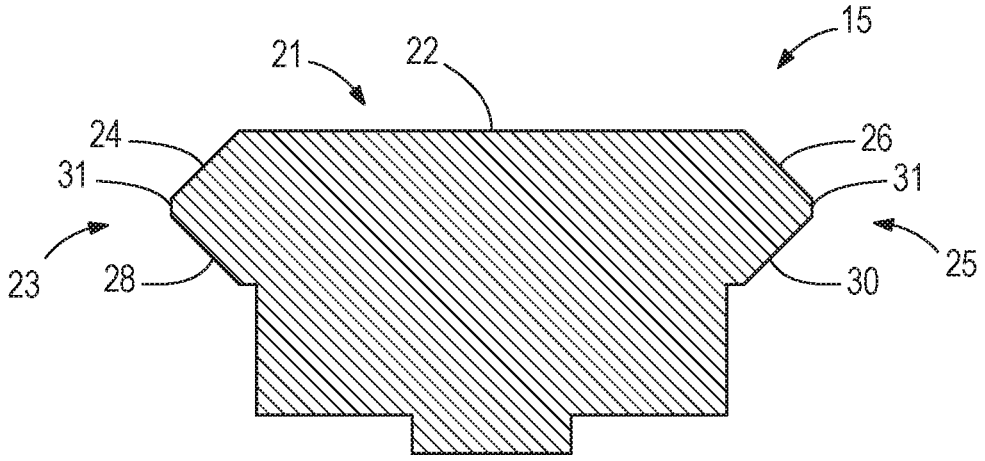
FIG. 2 is a cross-sectional view of the rail of the firearm of FIG. 1, taken along line C2 in FIG. 1.
Figure 3:
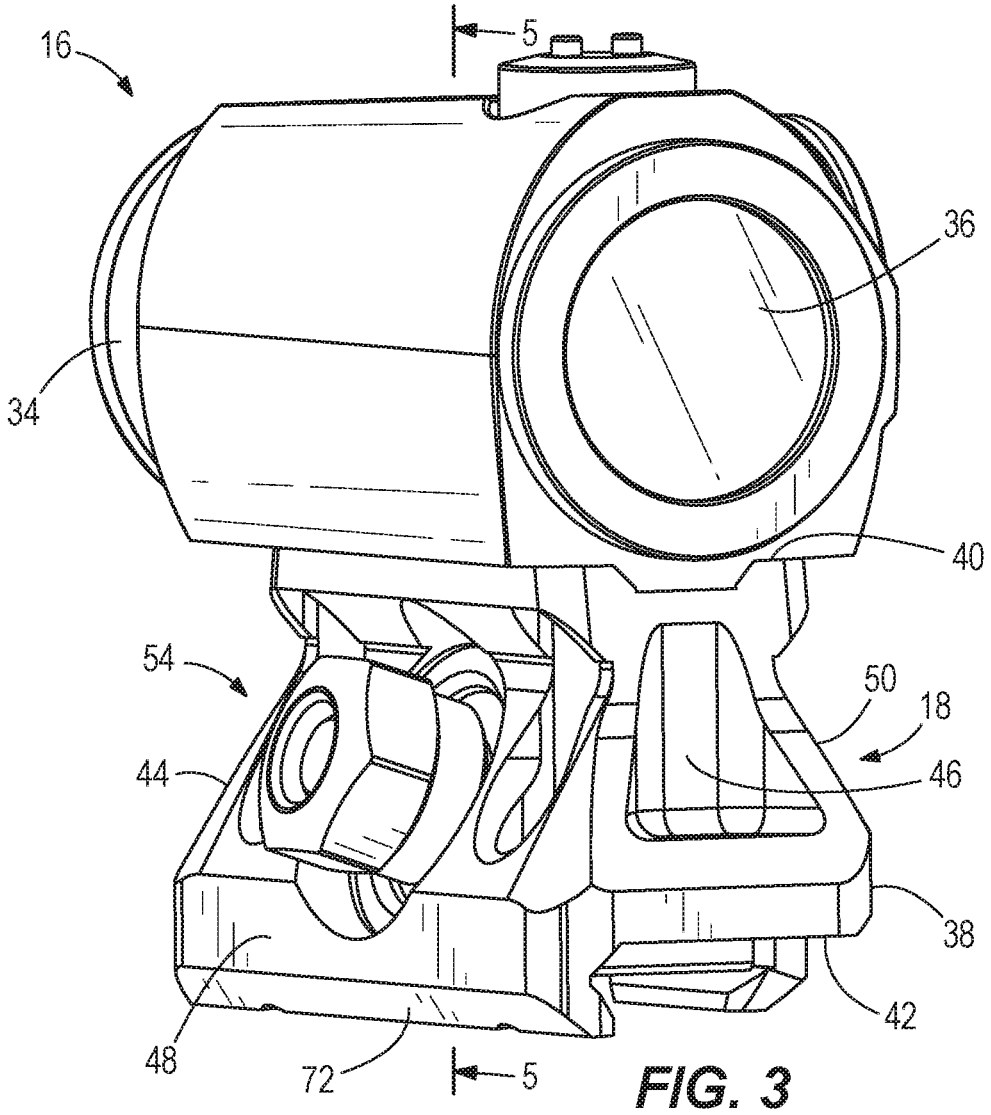
FIG. 3 is a perspective view of an accessory with an accessory mount, according to one embodiment of the present disclosure, which can be coupled to the rail of the firearm of FIG. 1.

FIG. 3 illustrates an accessory 16 and an accessory mount 18 according to one embodiment, which can be used to secure the accessory 16 to the rail 15 of the firearm 2 or to a rail on any other firearm or device (such as a stand). The illustrated accessory 16 is an optic (e.g., a scope) with a housing 34 containing one or more optic elements 36 (e.g., lenses). The accessory mount 18 is coupled to the housing 34 via a plurality of fasteners (not shown) and includes a body 38 with an upper side 40 adjacent the accessory 16, a lower side 42 opposite the upper side 40, and a front side 44, a rear side 46, and opposite lateral sides 48, 50 extending between the front side 44 and the rear side 46. The lower side 42 of the accessory mount includes a lower engagement surface 52 (FIG. 5) that is positioned adjacent the top surface 22 (FIG. 2) of the rail 15 when the accessory mount 18 is coupled to the rail 15 (e.g., FIG. 1).

Figure 5:
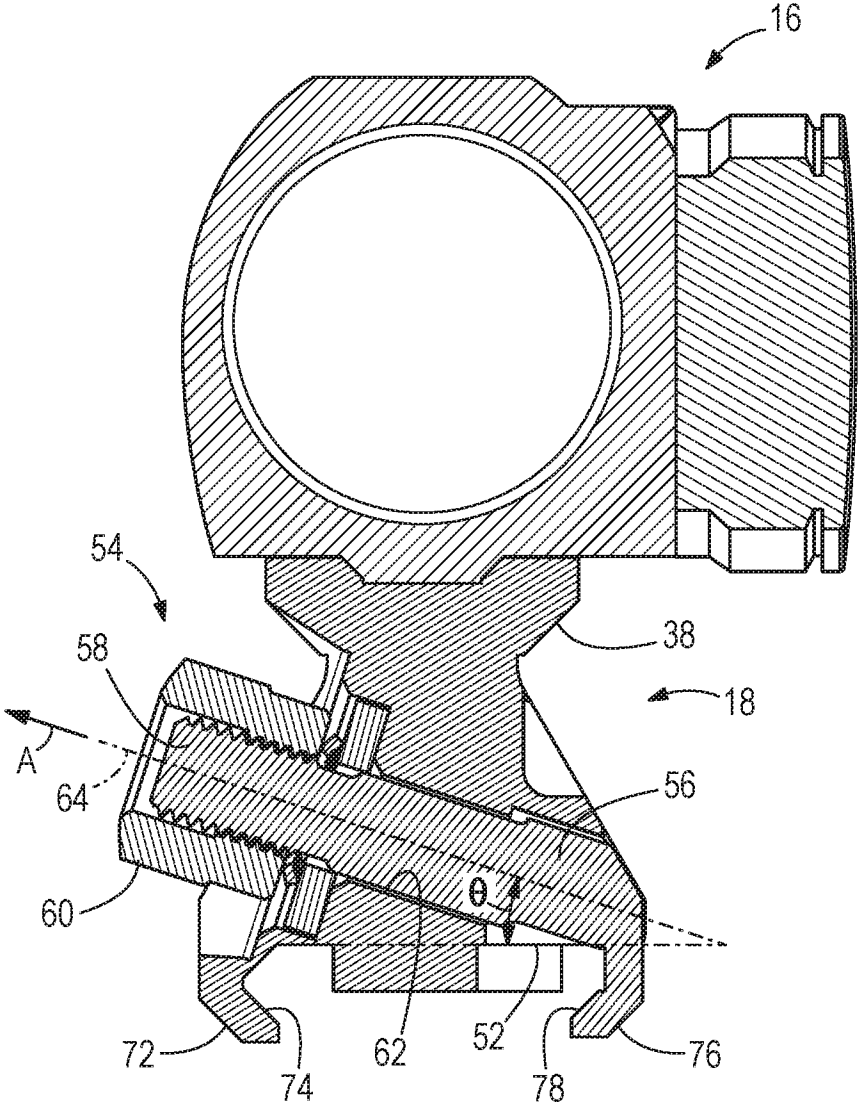
FIG. 5 is a cross-sectional view of the accessory and the accessory mount of FIG. 3, taken along line 5-5 in FIG. 3.

The accessory mount 18 further includes a clamp assembly 54 coupled to the body 38. The clamp assembly 54 includes a movable clamp member 56 with a threaded shaft 58 and an actuator 60, which in the illustrated embodiment is a nut 60 threadably engaged with the shaft 58. The shaft 58 is received within a bore 62 that extends through the body 38 of the accessory mount 18 along an axis 64. With reference to FIG. 5, the axis 64 is inclined at an angle θ relative to the lower engagement surface 52 of the body 38. That is, the axis 64 and the lower engagement surface 52 are oriented to define a non-zero included angle θ (i.e. the angle θ is greater than 0 degrees such that the axis 64 and the lower engagement surface 52 are not parallel). For example, in some embodiments, the angle θ is greater than zero degrees and less than or equal to 90 degrees, and in some embodiments, the angle θ is between 5 degrees and 90 degrees. In other embodiments, the angle θ is between 5 degrees and 80 degrees, or between 10 degrees and 75 degrees. In some embodiments, the angle θ is between 10 degrees and 50 degrees. In other embodiments, the angle θ is between 10 degrees and 45 degrees. In some embodiments, the angle θ is between 15 degrees and 20 degrees.

Figure 4:
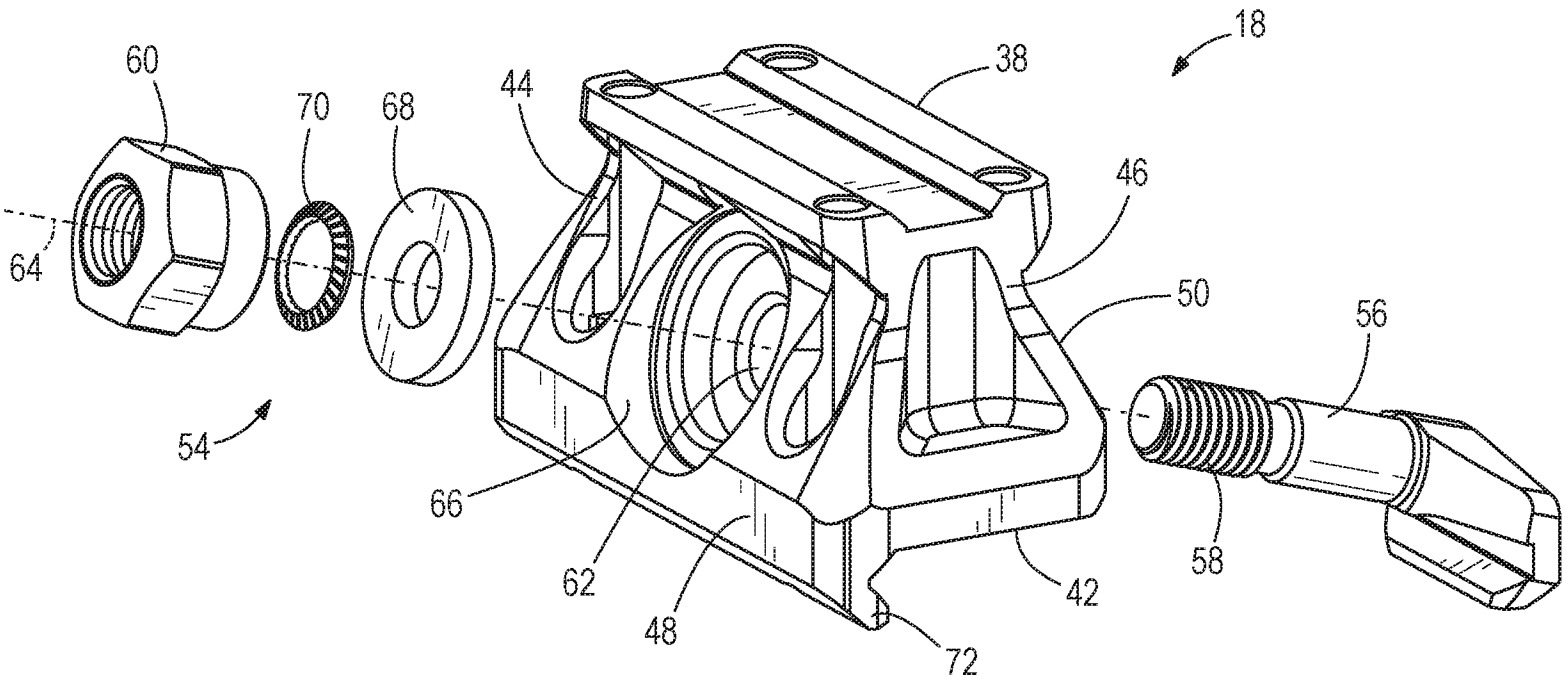
FIG. 4 is an exploded view of the accessory mount of FIG. 3.

With reference to FIG. 4, in the illustrated embodiment, a relief 66 in the first lateral side 48 surrounds the periphery of the bore 62 and provides clearance for a tool (e.g., a socket) to be slid over the nut 60 to facilitate rotating the nut 60. In some embodiments, the nut 60 may be replaced with a knob configured to be grasped and rotated by hand. In such embodiments, the knob may be knurled to provide increased grip.

In the illustrated embodiment, a first washer 68 and a second washer 70 are received on the shaft 58 between the nut 60 and the body 38. The first washer 68 is a flat washer that distributes a clamping load exerted by the nut 60 against the body 38 to inhibit wear on the nut 60 and/or the body 38. The second washer 70 is a disc spring or wave spring that is resiliently compressible to provide an axial preload and the threads of the nut 60 and the shaft 58, inhibiting the nut 60 from loosening. In other embodiments, one or both washers 68, 70 may be omitted, or other washer configurations may be used.

The clamp assembly 54 further includes a fixed clamp member 72 that projects from the lower side 42 of the body 38 and extends along the entire length of the body 38 from the front side 44 to the rear side 46. Alternatively, the fixed clamp member 72 may not extend the entire length of the body 38 or may be split into multiple segments. With reference to FIG. 5, the fixed clamp member 72 includes a first engagement surface 74 engageable with the first lower angled surface 28 of the rail 15. The movable clamp member 56 includes a hook 76 defining a second engagement surface 78 that is engageable with the second lower angled surface 30 on the rail 15. The shaft 58 and the hook 76 may be integrally formed together as a single piece. Alternatively, the shaft 58 and hook 76 may be formed separately and coupled together by welding, a mechanical fastener (e.g., a set screw) or any other suitable means.

The movable clamp member 56 is movable along the axis 64 (e.g., in response to rotation of the nut 60) to clamp the rail 15 between the first and second engagement surfaces 74, 78 and the lower engagement surface 52 of the body 38. The clamp assembly 54 thus provides three areas of contact (i.e. the surfaces 74, 28; the surfaces 78, 30; and the surfaces 52, 22) in a triangular pattern to secure the accessory mount 18 to the rail 15. In some embodiments, alternative actuators may be provided in place of the nut 60 to move the movable clamp member 56 along the axis 62. For example, the nut 60 may be replaced by a cam-lever pivotally coupled to the body 38.

Figure 6:
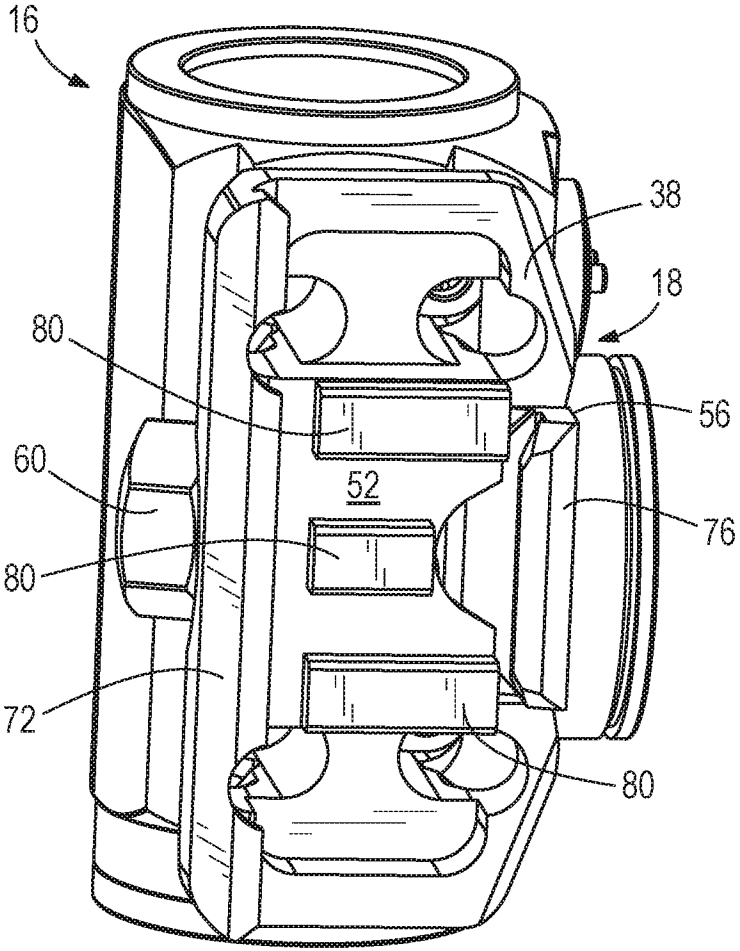
FIG. 6 is a perspective view illustrating a lower side of the accessory mount of FIG. 3.

With reference to FIG. 6, the illustrated accessory mount 18 further includes a plurality of recoil lugs 80 that projects from the lower engagement surface 52 of the body 38. The recoil lugs 80 extend laterally across the body 38 generally between the fixed clamp member 72 and the hook 76 of the movable clamp member 56. The recoil lugs 80 are sized and shaped to be received within the notches 32 of the rail 15. That is, the recoil lugs 80 are engageable with the rail 15 to secure the accessory mount 18 against recoil forces generated by discharging the firearm 2. In other embodiments, different numbers and/or arrangements of recoil lugs 80 may be provided, depending on the overall length of the accessory mount 18, for example.

In operation, to couple the accessory 16 to the firearm 2, the accessory mount 18 is positioned on the rail 15 by first aligning the recoil lugs 80 with notches 32 in the rail 15, and then inserting the recoil lugs 80 into the notches 32 until the lower engagement surface 52 of the body 38 abuts the top side 22 of the rail (FIGS. 1, 2, and 6). Next, the user rotates the nut 60 relative to the shaft 58 about the axis 64 in a tightening direction (e.g., clockwise). As the nut 60 is rotated relative to the shaft 58, the movable clamp member 56 moves along the axis 64 in the direction of arrow A in FIG. 5. This decreases the spacing between the fixed clamp member 72 and the hook 76 of the movable clamp member 56. The user continues to rotate the nut 60 in the tightening direction until the fixed clamp member 72 and the movable clamp member 56 engage the first and second sides 23, 25 of the rail 15. For example, in the illustrated embodiment, the first and second engagement surfaces 74, 78 of the clamp assembly 54 bear against the lower angled surfaces 28, 30 of the rail. This securely clamps the accessory mount 18 to the rail 15.

The angled orientation of the movable clamp member 56 and the nut 60 advantageously reduces the overall width of the accessory mount 18. In addition, the nut 60 is less likely to snag on straps, webbing, clothing, etc.

Figure 7:
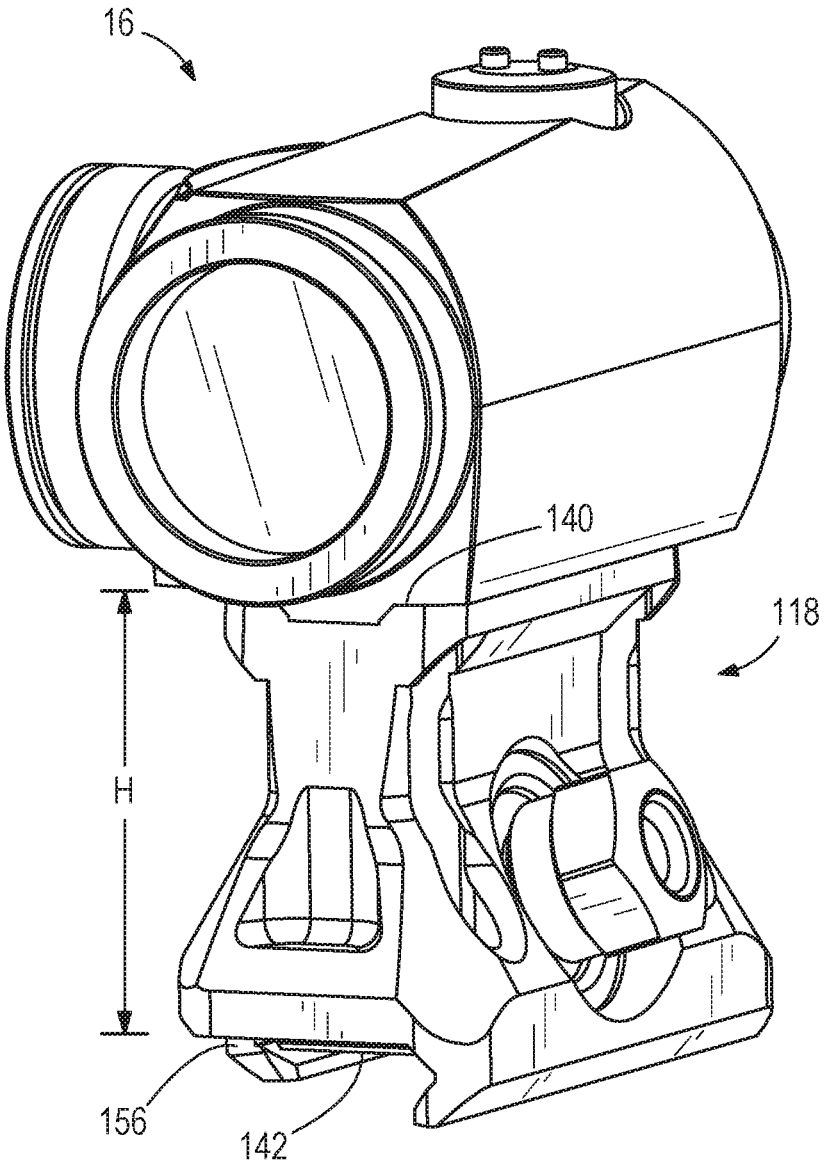
FIG. 7 is a perspective view of an accessory with an accessory mount, according to another embodiment of the present disclosure, which can be coupled to the rail of the firearm of FIG. 1.

FIG. 7 illustrates an accessory mount 118 according to another embodiment. The accessory mount 118 is similar to the accessory mount 18 described above with reference to FIGS. 3-6. Accordingly, features and elements of the accessory mount 118 corresponding with features and elements of the accessory mount 18 are given like reference numbers plus 100. In addition, the following description focuses primarily on differences between the accessory mount 118 and the accessory mount 18.

The body 138 of the accessory mount 118 has a greater height H (i.e. a greater distance between the upper side 140 and the lower side 142) than the body 38 of the accessory mount 18. As such, the body 138 can accommodate the a steeper inclination angle θ for the movable clamp member 156.

Figure 8:
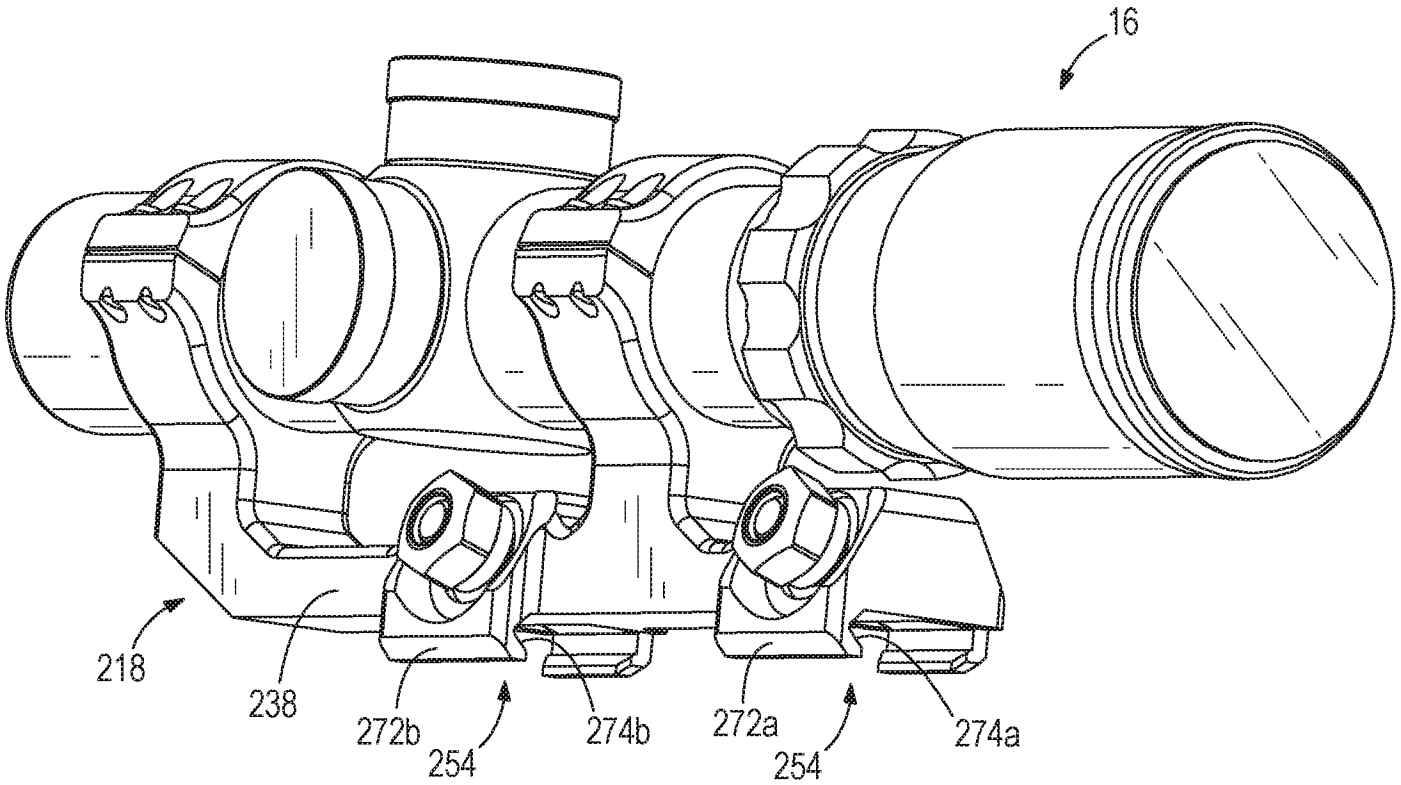
FIG. 8 is a perspective view of an accessory with an accessory mount, according to another embodiment of the present disclosure, which can be coupled to the rail of the firearm of FIG. 1.

FIG. 8 illustrates an accessory mount 218 according to another embodiment. The accessory mount 218 is similar to the accessory mount 18 described above with reference to FIGS. 3-6. Accordingly, features and elements of the accessory mount 218 corresponding with features and elements of the accessory mount 18 are given like reference numbers plus 200. In addition, the following description focuses primarily on differences between the accessory mount 218 and the accessory mount 18.

The accessory mount 218 is configured to secure a relatively long accessory 16, such as a high-power scope, to the rail 15. As such, the mount 218 includes an elongated body 238 and two clamping assemblies 254, each having a structure and operation similar to the clamping assembly 54 described above with reference to FIGS. 3-6. There is a gap between the two clamping assemblies 254, such that this embodiment does not include a continuous fixed clamp member that projects from the lower side of the body 238 and extends along the entire length of the body 238 from the front side to the rear side. Instead, the fixed clamp member of this embodiment is split into two segments 272*a*, 272*b*, and thus includes first and second engagement surfaces 274*a*, 274*b* engageable with the first lower angled surface 28 of the rail 15. In other embodiments, the accessory mount 218 may include three or more clamping assemblies 254.

Figure 9:
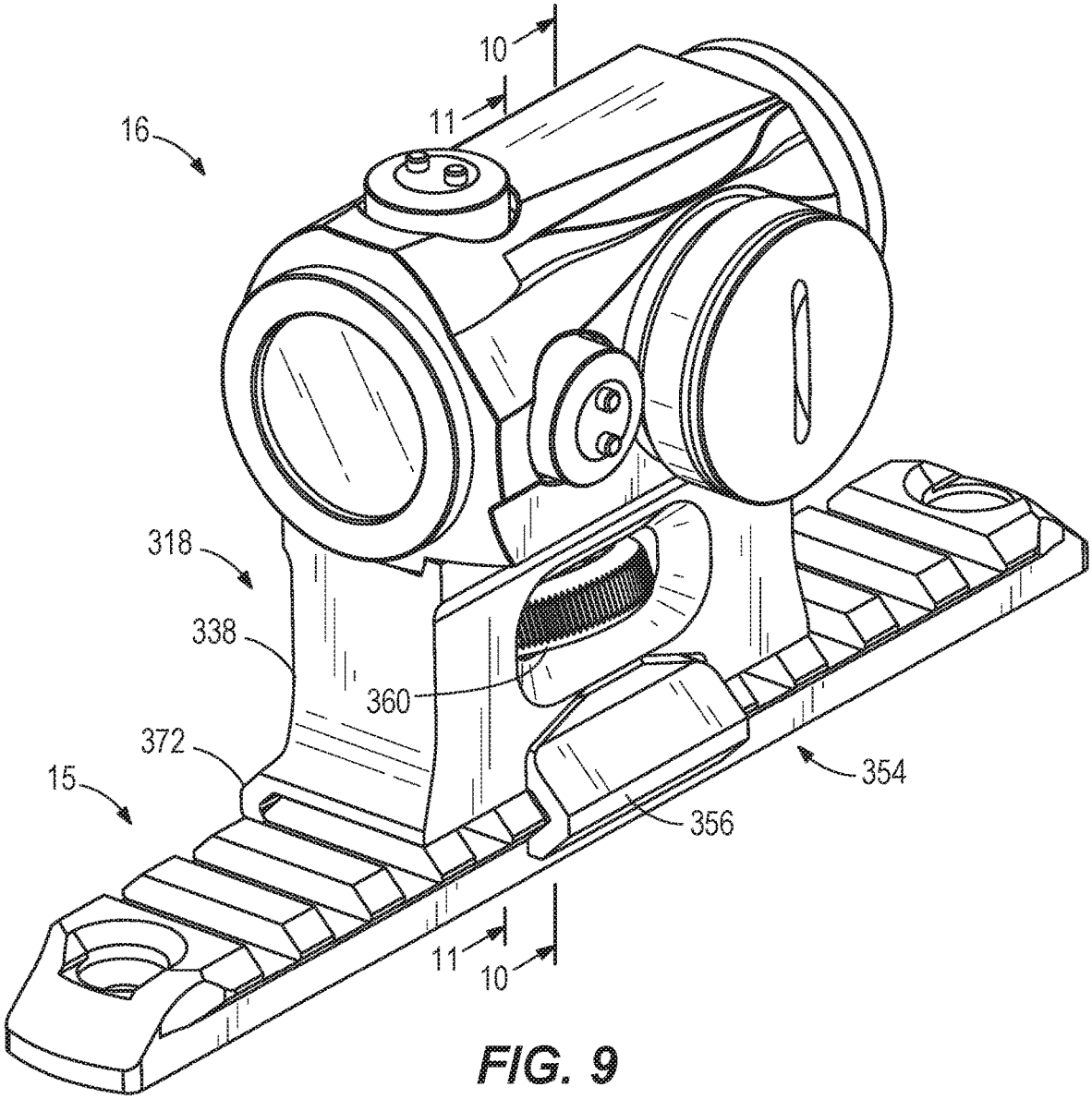
FIG. 9 is a perspective view of an accessory with an accessory mount, according to another embodiment of the present disclosure, coupled to a rail.
Figure 10:
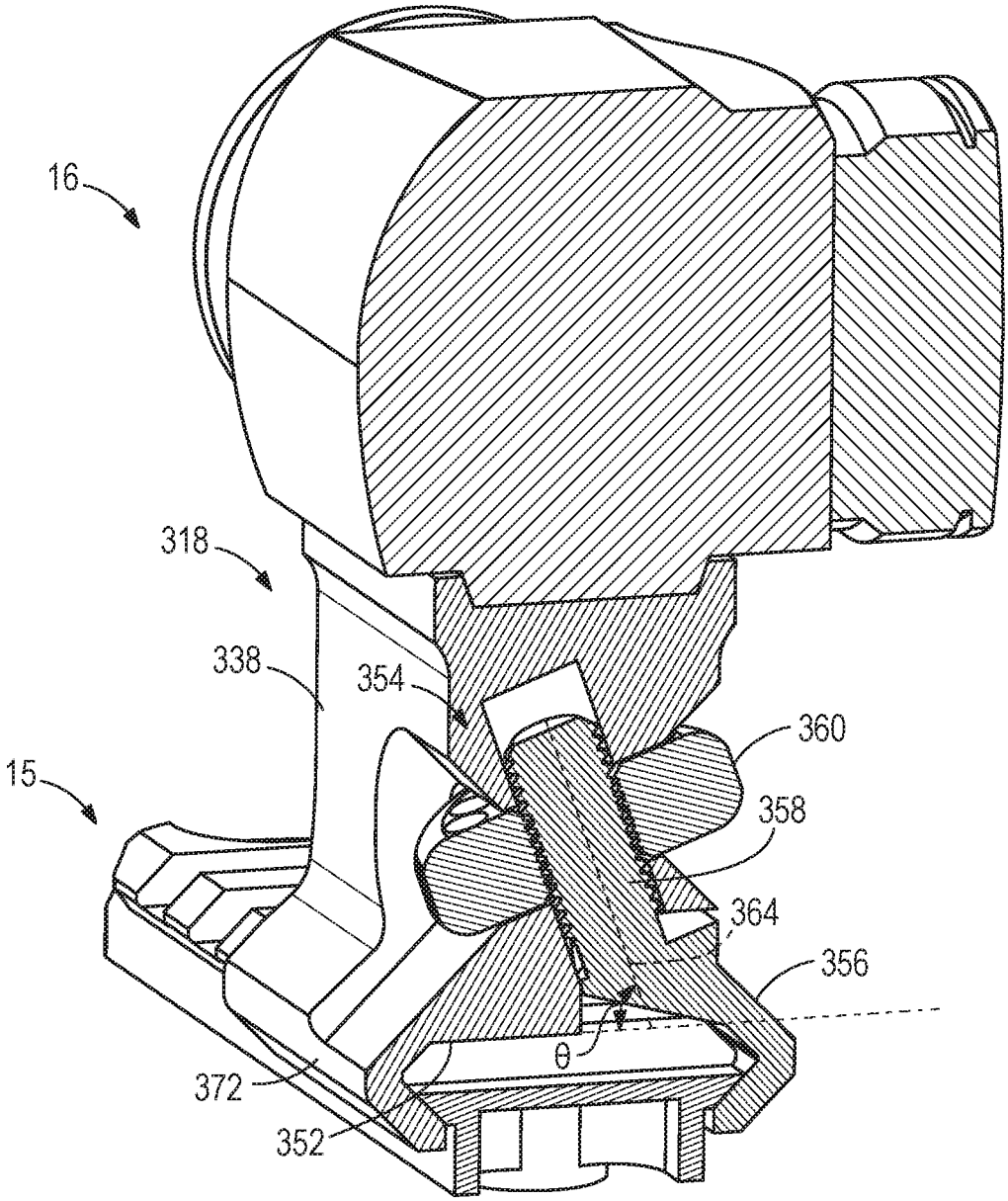
FIG. 10 is a cross-sectional view taken along line 10-10 in FIG. 9.
Figure 11:
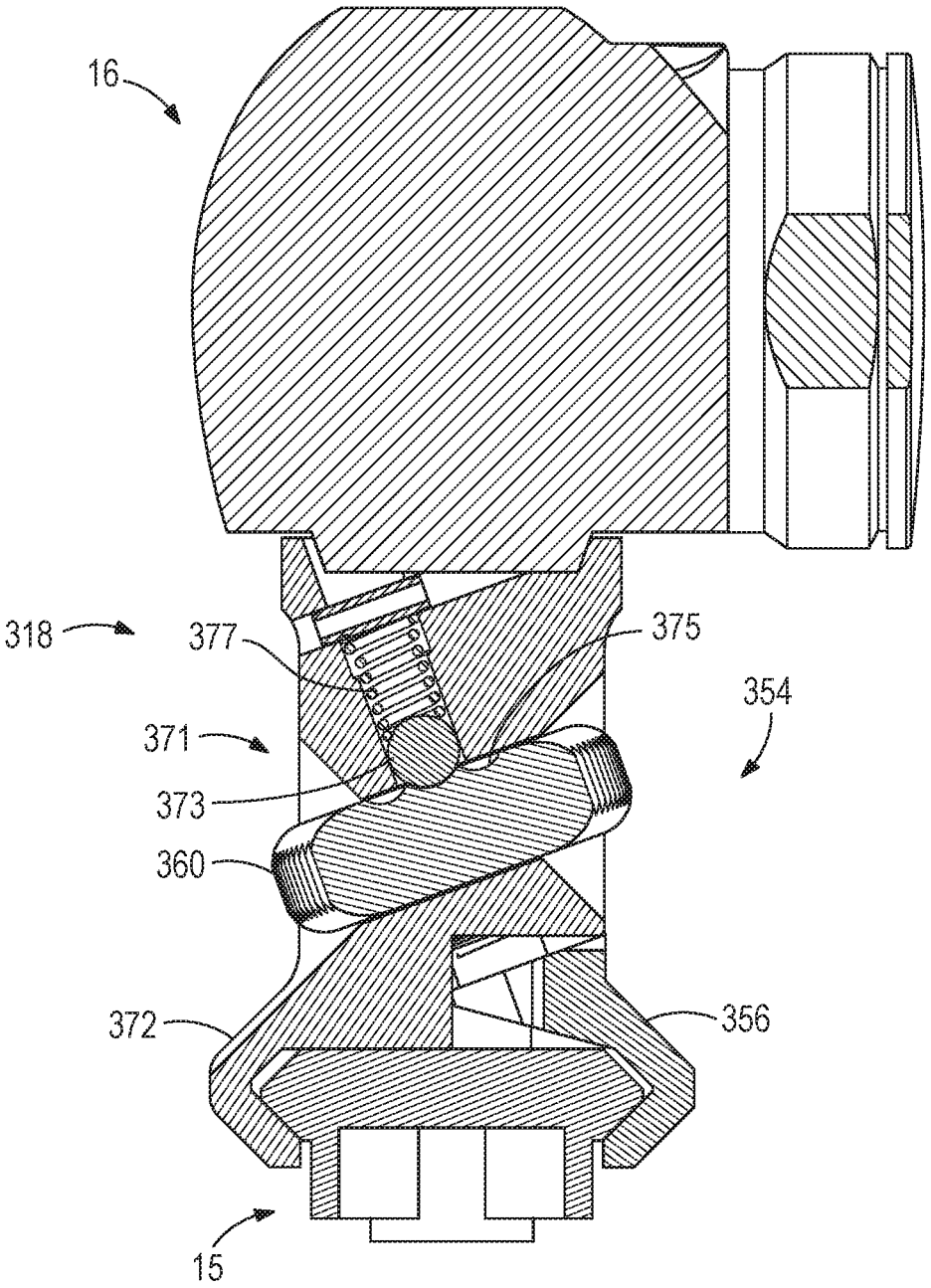
FIG. 11 is a cross-sectional view taken along line 11-11 in FIG. 1.

FIGS. 9-11 illustrate an accessory mount 318 according to another embodiment. The accessory mount 318 is similar to the accessory mount 18 described above with reference to FIGS. 3-6. Accordingly, features and elements of the accessory mount 318 corresponding with features and elements of the accessory mount 18 are given like reference numbers plus 300. In addition, the following description focuses primarily on differences between the accessory mount 318 and the accessory mount 18.

Referring to FIG. 10, the actuator 360 of the clamp assembly 354 in the illustrated embodiment is a knurled wheel with a central aperture that is threadably engaged with the shaft 358. The actuator 360 extends laterally through the body 338 of the mount 318, such that the actuator 360 can be accessed and manipulated from either side of the mount 318 (facilitating ambidextrous operation).

In the illustrated embodiment, the shaft 358 of the movable clamp member 356 is oriented such that the included angle θ between the axis 364 and the lower engagement surface 352 is between 45 degrees and 90 degrees, or between 60 degrees and 90 degrees in some embodiments. In other embodiments, the angle θ may be between 70 degrees and 80 degrees.

With reference to FIG. 11, the clamp assembly 354 further includes a detent mechanism 371 configured to retain the actuator 360 in a set position and inhibit inadvertent loosening of the actuator 360. The illustrated detent mechanism 371 includes a detent 373, a plurality of recesses 375 formed in the actuator 360, and a spring 377 configured to bias the detent 373 into engagement with the plurality of recesses 375. In other embodiments, the detent 373 may be provided on the actuator 360, and the recesses 375 may be provided in the body 338 of the mount 318. In other embodiments, the detent mechanism 371 may have yet other configurations.

When a user desires to tighten the actuator 360 (e.g., to secure the mount 318 to the rail 15), the user may grasp or press against the actuator 360 to rotate the actuator 360 about the axis 364 in a tightening direction (FIG. 10). As the actuator 360 rotates, the ball 373 rides in an out of the recesses 375, accompanied by corresponding compression and expansion of the spring 377 (FIG. 11). The engagement between the ball 373 and the recesses 376 may provide the user with tactile and/or audible feedback during rotation of the actuator 360. Once the rail 15 is tightly clamped between the movable clamp member 356 and the fixed clamp member 372. The engagement between the ball 373 and a corresponding recess 375 inhibits the actuator 360 from rotating and loosening the clamp assembly 354 without deliberate action from the user.

Although the disclosure has been described in detail with reference to certain preferred embodiments, variations and modifications exist within the scope and spirit of one or more independent aspects of the disclosure as described.

Various features of the invention are set forth in the following claims:

What is claimed is:

1. An accessory mount for coupling an accessory to a mounting interface on a firearm, the accessory mount comprising:

a body including a lower engagement surface configured to engage a top surface of the mounting interface;

a fixed clamp member extending from the body;

a movable clamp member configured to move along an axis relative to the fixed clamp member to clamp the mounting interface between the movable clamp member and the fixed clamp member; and an actuator configured to move the movable clamp member along the axis;

wherein the movable clamp member includes a hook engageable with the mounting interface and a threaded shaft extending from and integrally formed with the hook as a single piece, such that the threaded shaft and the hook are movable together in each direction along the axis, wherein the axis and the lower engagement surface define an included angle greater than 0 degrees.

2. The accessory mount of claim 1, wherein the included angle is between 5 degrees and 80 degrees.

3. The accessory mount of claim 1, wherein the actuator is in threaded engagement with the threaded shaft.

4. The accessory mount of claim 3, wherein the actuator includes a nut.

5. The accessory mount of claim 3, wherein the actuator includes a knurled wheel.

6. The accessory mount of claim 5, further comprising a detent engageable with the knurled wheel to inhibit rotation of the knurled wheel about the axis.

7. The accessory mount of claim 1, wherein the actuator is rotatable about the axis to move the movable clamp member along the axis.

8. The accessory mount of claim 1, further comprising a recoil lug projecting from the lower engagement surface.

9. The accessory mount of claim 8, wherein the mounting interface includes a notch, and wherein the recoil lug is insertable into the notch.

10. The accessory mount of claim 1, wherein the body includes a bore extending along the axis, and wherein the threaded shaft is received within the bore.

11. An accessory mount for coupling an accessory to a mounting interface on a firearm, the mounting interface having a top surface and a notch formed in the top surface, the accessory mount comprising:

a body including a lower engagement surface configured to engage the top surface of the mounting interface;

a fixed clamp member extending from the body;

a movable clamp member including a threaded shaft and a hook integrally formed with the threaded shaft as a single piece, the movable clamp member configured to move along an axis relative to the fixed clamp member to clamp the mounting interface between the movable clamp member and the fixed clamp member, wherein a portion of the movable clamp member is received within a bore extending at least partially through the body along the axis;

an actuator configured to move the movable clamp member along the axis, wherein the actuator is rotatable relative to the body in a tightening direction to clamp the accessory mount to the mounting interface; and a recoil lug projecting from the lower engagement surface such that the recoil lug is insertable into the notch, wherein the axis and the lower engagement surface define an included angle greater than 0 degrees.

12. The accessory mount of claim 11, wherein the actuator includes a nut coupled to the threaded shaft.

13. The accessory mount of claim 12, wherein rotation of the nut relative to the threaded shaft is configured to move the movable clamp member along the axis.

14. The accessory mount of claim 12, wherein the nut is rotatable about the axis.

15. The accessory mount of claim 14, wherein the axis and the lower engagement surface define an included angle between 5 degrees and 90 degrees.

16. The accessory mount of claim 15, wherein the included angle is between 5 degrees and 80 degrees.

17. The accessory mount of claim 11, wherein the mounting interface includes a Picatinny rail.

18. A method of coupling an accessory mount for a firearm accessory to an accessory interface having a first side, a second side, and a top side extending between the first side and the second side, the method comprising:

positioning a lower engagement surface of the accessory mount against the top side of the accessory interface;

positioning a fixed clamp member of the accessory mount against the first side of the accessory interface;

moving a movable clamp member of the accessory mount along an axis and into engagement with the second side of the accessory interface, the movable clamp member including a hook portion and a shaft portion extending from and integrally formed with the hook portion as a single piece; and clamping the accessory interface between the fixed clamp member and the hook portion of the movable clamp member by rotating an actuator relative to a body of the accessory mount to secure the accessory mount to the accessory interface, wherein the axis is oriented at a non-zero angle relative to the lower engagement surface.

19. The method of claim 18, wherein clamping the accessory interface between the fixed clamp member and the movable clamp member includes rotating the actuator about the axis.

20. The method of claim 18, wherein the shaft portion of the movable clamp member is received within a bore extending at least partially through the accessory mount.

21. The method of claim 20, further comprising inserting a recoil lug projecting from the lower engagement surface into a notch formed in the top side of the accessory interface.

22. The method of claim 21, wherein the axis and the lower engagement surface define an included angle between 5 degrees and 80 degrees.

23. The accessory mount of claim 11, wherein the lower engagement surface extends between opposite first and second sides of the body, and wherein the actuator is accessible from both the first side and the second side of the body.

* * * * *